United States Patent [19]

Sifford et al.

[11] 4,355,957

[45] Oct. 26, 1982

[54] BLADE DAMPER

[75] Inventors: Perry P. Sifford, Jupiter, Fla.; Jerry H. Griffin, Pittsburgh, Pa.

[73] Assignee: United Technologies Corporation, Hartford, Conn.

[21] Appl. No.: 274,897

[22] Filed: Jun. 18, 1981

[51] Int. Cl.[3] ..... F01D 5/16

[52] U.S. Cl. ..... 416/145; 416/190; 416/193 A; 416/500

[58] Field of Search ..... 416/144, 145, 190, 193 A, 416/500

[56] References Cited

U.S. PATENT DOCUMENTS

| | | | |
|---|---|---|---|
| 2,999,668 | 9/1961 | Howald et al. | 416/145 X |
| 3,181,835 | 5/1965 | Davis | 416/145 |
| 3,748,060 | 7/1973 | Hugoson et al. | 416/193 A X |
| 3,881,844 | 5/1975 | Hennessey et al. | 416/145 |
| 3,888,601 | 6/1975 | Glassburn | 416/144 |
| 4,182,598 | 1/1980 | Nelson | 416/193 A |

*Primary Examiner*—Everette A. Powell, Jr.
*Attorney, Agent, or Firm*—Jack N. McCarthy

[57] ABSTRACT

This invention relates to the construction of a turbine rotor having a rotor disc with a plurality of blades, said blades having roots fitted into slots around the periphery of the disc with each blade engaging a stop means to properly position it, said blades being held in place by a cover plate fixed to the rotor disc and said stop means; a pocket is formed on the front face of each blade while an annular groove on said cover plate is positioned over said circumferential ring of pockets. Each pocket has an outer flat surface placed at an angle so that each surface intersects the outer surface of the annular groove; a stiff solid damper having a rectangular surface is positioned in each pocket so that one end of said surface will be supported by the outer surface of the annular groove while the other end of said surface will be supported by the outer surface of the pocket when the damper is thrown outwardly by centrifugal force.

5 Claims, 4 Drawing Figures

BLADE DAMPER

TECHNICAL FIELD

This invention relates to blade damping and more particularly to loosely mounted vibration dampers used with gas turbine blades exposed to high temperatures.

BACKGROUND ART

In the past, various means of blade damping have been used. One of the accepted blade damping schemes is a toggle device. A toggle is a non-structural member which is held in physical contact with a turbine blade by centrifugal force during rotation of the turbine engine. The toggle reduces the vibratory action of the blade by imposing a retarding force due to friction on the blade at the point of contact between the toggle the blade. Loosely mounted vibration dampers have been used and two such constructions are shown in U.S. Pat. No. 3,666,376 and U.S. Pat. No. 4,182,598.

DISCLOSURE OF INVENTION

The primary object of this invention is to dampen the vibrations in a turbine blade by placing a damper shaped in the form of a rectangular solid between a portion of the blade and a portion of a cover plate, said damper being essentially square in cross-section and rectangular in circumferential direction; the damper is positioned in a four-sided pocket in a portion of the blade facing the cover plate and extends into an annular groove in the cover plate. Since the outer flat surface of the pocket is at an angle crossing the outer surface of the annular groove, under centrifugal force one location at one end of the damper is supported by the outside diameter of the annular groove in the cover plate and another location at the other end of the damper is supported by the outer surface of the pocket.

Another object of this invention is to provide a blade damping device wherein the damper can be properly placed between the blade and cover plate which simplifies means for locating the damper and eliminating expensive locating features.

A further object of this invention is to provide a mechanical damper with a large degree of stiffness. The damper transmits load directly into a stiff cover plate. The weight of the damper can be controlled by varying its thickness or by placing a hole along its length.

and

Figure 2:
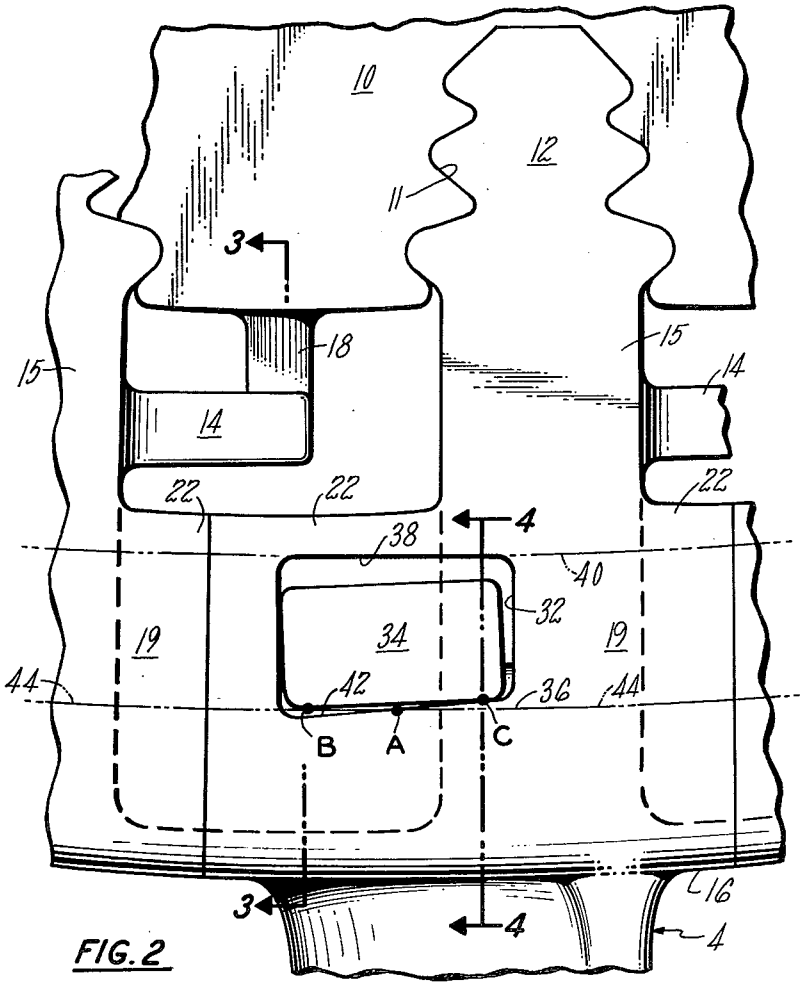
FIG. 2 is a fragmentary view taken along the forward face of the outer periphery of the disc with the root of a rotor blade positioned therein showing the invention.
Figure 4:
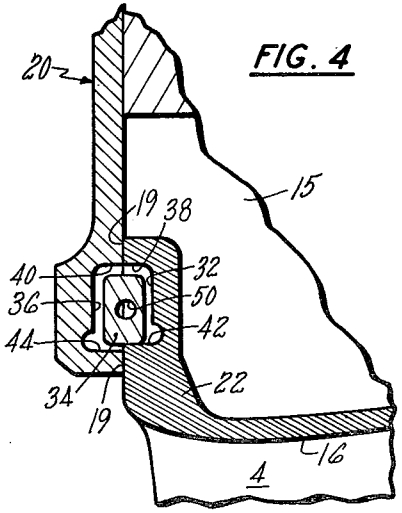

FIG. 4 is a fragmentary view of the cover plate and blade showing the invention taken on the line 4—4 of FIG. 2.

BEST MODE FOR CARRYING OUT THE INVENTION

Figure 1:
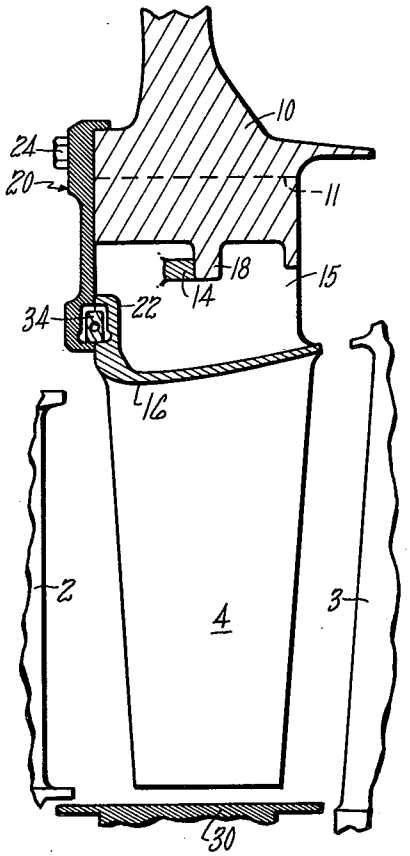
FIG. 1 is a fragmentary view of a portion of a turbine engine showing the disc, rotor blade, and outer shroud assembly.

FIG. 1 shows a portion of a turbine disc 10 of a gas turbine engine with axially extending slots 11 on its periphery, each of which receives the root 12 of one of the blades 4. Fixed vanes 2 are located upstream of the blades 4 and fixed vanes 3 are located downstream of said blades. A portion of a blade tip seal member 30 is shown which is fixed to a casing member, not shown, for completing a housing. A similar construction is shown in U.S. Pat. No. 3,836,279. Each blade has a projection 44 extending to one side thereof from an extended neck section 15 between the root 12 and the platform 16. To provide a stop for the projection 14 of each blade, a projection 18 extends outwardly from the periphery of the turbine disc 10 between each of the slots 11. When the projection 14 engages the stop 18, the blade 4 is properly positioned with respect to the disc 10 to receive a cover plate 20 which engages the forward face of the outer periphery of the disc 10 and engages the forward faces 19 of buttress members 22 of blades 4. A buttress member 22 extends inwardly from the forward edge of each platform 16 and extends for the width of the platform 16 forming part of the extended neck section 15 where they meet. Each buttress member 22 abuts the adjacent buttress member 22 on adjacent blades 4. The cover plate 20 can be affixed to the outer periphery of the disc 10 by any means desired, such as by bolts 24.

The forward face 19 of each buttress member 22 includes a pocket, or opening, 32 for receiving a damper member 34. Said cover plate has an annular groove 36 located therearound which faces the annular ring of pockets 32 formed by the plurality of blades 4 positioned around the disc 10. This annular groove 36 is shown in phantom in FIG. 2. Each pocket 32 is formed as a four-sided figure, with the inner surface 38 shown aligned with the inner surface 40 of the annular groove 36. While the inner surfaces are shown aligned, this alignment is not necessary for the damping action. The side surfaces of each pocket 32 are formed straight and approximately lying on a radial line extending outwardly from the center of the disc 10. The outer surface 42 of each pocket 32 is formed at an angle to the outer surface 44 of the annular groove 36 so as to intersect it. In FIG. 2, the outer surface 42 of the pocket 32 can be seen crossing the outer surface 44 of the annular groove 36 at A.

Figure 3:
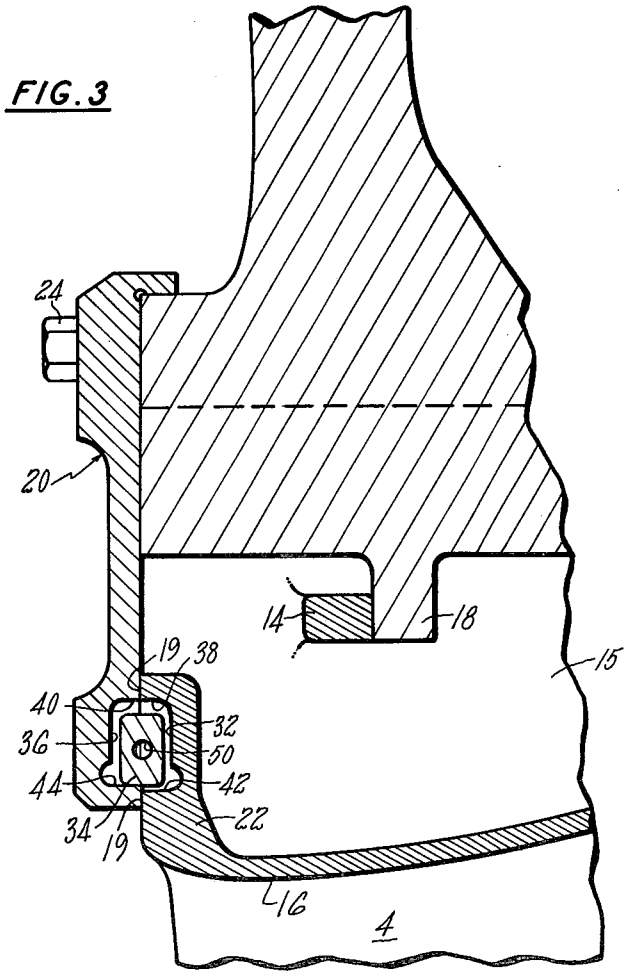
FIG. 3 is an enlarged view of a portion of FIG. 1 which is also taken on the line 3—3 of FIG. 2.

The damper member 34 is formed approximately square in cross section (see FIGS. 1, 3 and 4) with rectangular surfaces in the circumferential direction (see FIG. 2). This solid damper member shape prevents it from being assembled incorrectly. It can be seen that the damper member 34 is supported at one end at point B by the outer surface 44 of the annular groove 36 (see FIG. 2), while the other end of the damper member 34 is supported at the other end at point C by the outer surface 42 of the pocket 32 (see FIG. 2), when the dampers are thrown outwardly by centrifugual force. When a blade 4 bends about its attachment, sliding can occur at either point B or C, providing friction damping. The weight of the damper 34 can be reduced, if desired, by drilling a hole 50 therein. For a high spring rate it is desired that the cover plate be a complete ring and not segmented.

We claim:

1. A rotor comprising a disc with blade connector means; blades being connected to said turbine disc around its periphery; each blade having an airfoil, platform, a root section, and a forwardly facing surface adjacent the platform; means for holding said blades in said disc against axial movement; said holding means including a cover plate fixed to said turbine disc and extending over all of the forwardly facing surfaces of adjacent blades; a plurality of said forwardly facing surfaces having a damper pocket located therein, each pocket having an inner and outer surface, said cover plate having an annular groove located therearound having an inner and outer cylindrical surface; each outer surface of each pocket being at an angle to and crossing the outer cylindrical surface of the annular groove; a stiff damper being positioned in each of a plurality of said pockets and extending into said annular groove; one end of said damper being supported by the outer surface of the annular groove in the cover plate and the other end of the damper being supported by the outer surface of the pocket when the dampers are thrown outwardly by centrifugal force.

2. A combination as set forth in claim 1 wherein each stiff damper is formed as an elongated solid having a rectangular surface, said length of said rectangular surface extending along the annular groove facing the outer surface of its pocket and outer surface of said annular groove.

3. A combination as set forth in claim 2 wherein said stiff damper has a square cross-section therethrough.

4. A combination as set forth in claim 3 wherein said cover plate is a solid annular member having a continuous annular groove therein.

5. A rotor comprising a disc with blade connector means; blades being connected to said turbine disc around its periphery; each blade having an airfoil, platform, extended neck section, a root section, and a buttress member extending across the front of the platform for the entire width of the blade; means for holding said blades in said disc against axial movement; said holding means including a cover plate fixed to said turbine disc and extending over all of the adjacent buttress members of adjacent blades; a plurality of said buttress members having a damper pocket located therein, each pocket having an inner and outer surface, said cover plate having an annular groove located therearound having an inner and outer cylindrical surface; each outer surface of each pocket being at an angle to and crossing the outer cylindrical surface of the annular groove; a stiff damper being positioned in each of a plurality of said pockets and extending into said annular groove; one end of said damper being supported by the outer surface of the annular groove in the cover plate and the other end of the damper being supported by the outer surface of the pocket when the dampers are thrown outwardly by centrifugal force.

* * * * *